US007323074B2

(12) United States Patent
Dort et al.

(10) Patent No.: US 7,323,074 B2
(45) Date of Patent: Jan. 29, 2008

(54) HAY BALING LAMINATE OF A NONWOVEN AND A KNITTED NET

(75) Inventors: Thomas Dort, Wichita, KS (US); James Flick, Wichita, KS (US); Mike DeWeese, Kingman, KS (US); Lyndie Henrie, Kaysville, UT (US); Dennis Gregory McCabe, Kingman, KS (US); Paul Schmidt, Pretty Prairie, KS (US); Nick Carter, Mooresville, NC (US)

(73) Assignee: Polymer Group, Inc., Charlotte, NC (US)

( * ) Notice: Subject to any disclaimer, the term of this patent is extended or adjusted under 35 U.S.C. 154(b) by 0 days.

(21) Appl. No.: 10/971,243

(22) Filed: Oct. 22, 2004

(65) Prior Publication Data

US 2005/0124252 A1 Jun. 9, 2005

(51) Int. Cl.
*B32B 37/00* (2006.01)

(52) U.S. Cl. ..... 156/148; 156/149; 206/83.5

(58) Field of Classification Search ..... 156/184, 156/148, 149; 206/83.5
See application file for complete search history.

(56) References Cited

U.S. PATENT DOCUMENTS

| | | | | | |
|---|---|---|---|---|---|
| 3,360,421 | A | * | 12/1967 | Sands | 156/148 |
| 3,647,061 | A | * | 3/1972 | Kaupin | 206/83.5 |
| 3,674,139 | A | * | 7/1972 | Manasian et al. | 206/83.5 |
| 3,762,985 | A | * | 10/1973 | Chaitman | 156/268 |
| 3,766,115 | A | * | 10/1973 | Sands | 524/188 |
| 3,867,188 | A | * | 2/1975 | Campbell et al. | 442/99 |
| 3,994,116 | A | * | 11/1976 | McCormick | 53/418 |
| 3,999,940 | A | * | 12/1976 | Freeman | 428/96 |
| 4,324,720 | A | * | 4/1982 | Swihart | 106/287.14 |
| 4,569,439 | A | * | 2/1986 | Freye et al. | 206/83.5 |
| 4,570,789 | A | * | 2/1986 | Fritz et al. | 206/83.5 |
| 4,842,915 | A | * | 6/1989 | Hartmann et al. | 428/95 |
| 5,104,703 | A | * | 4/1992 | Rachman et al. | 428/35.6 |
| 5,104,714 | A | * | 4/1992 | Leiber et al. | 428/131 |
| 5,380,582 | A | * | 1/1995 | Neely et al. | 428/220 |
| 5,491,017 | A | * | 2/1996 | Todt | 428/198 |
| 5,643,653 | A | * | 7/1997 | Griesbach et al. | 428/120 |
| 5,723,217 | A | * | 3/1998 | Stahl et al. | 428/401 |
| 6,306,234 | B1 | * | 10/2001 | Barker et al. | 156/148 |
| 6,321,425 | B1 | * | 11/2001 | Putnam et al. | 28/104 |

FOREIGN PATENT DOCUMENTS

| | | | |
|---|---|---|---|
| GB | 2348633 | A * | 10/2000 |
| JP | 04-53506 | A * | 2/1992 |
| WO | WO 96/10107 | | 4/1996 |

* cited by examiner

*Primary Examiner*—Jeff H. Aftergut
(74) *Attorney, Agent, or Firm*—Kilyk & Bowersox, PLLC; Valerie Calloway

(57) ABSTRACT

The present invention is directed to a laminated net, and more specifically to a laminate comprising a nonwoven fabric and knitted net to be utilized as rounded bale wrap, wherein the wrap maintains the integrity of the bale during, pick-up, transport, and storage. The net of the present invention is laminate to nonwoven fabric. The nonwoven fabric provides additional coverage to the rounded bale so as to maintain the compact shape of the bale during pick-up, transport, and storage.

17 Claims, 2 Drawing Sheets

HAY BALING LAMINATE OF A NONWOVEN AND A KNITTED NET

TECHNICAL FIELD

The present invention is directed to a laminated net, and more specifically to a laminate comprising a nonwoven fabric and knitted net to be utilized as rounded bale wrap, wherein the wrap maintains the integrity of the bale during, pick-up, transport, and storage.

The net of the present invention is laminate to nonwoven fabric. The nonwoven fabric provides additional coverage to the rounded bale so as to maintain the compact shape of the bale during pick-up, transport, and storage.

The present invention generally relates to a laminated net, and more specifically to a laminate comprising a nonwoven fabric and knitted net to be utilized as rounded bale wrap, wherein the wrap maintains the integrity of the bale during, pick-up, transport, and storage.

BACKGROUND OF THE INVENTION

Netting is often prepared either by knitting, weaving, or extrusion. Knitted netting typically comprises a plurality of threads oriented in a first direction and being essentially equal spaced from one another, and having wefts oriented in a second direction which is perpendicular to the first direction, the threads and wefts being interlocked and secured. Nets may be prepared by a Raschel knitting method, a process in which the threads are attached to knitting elements that comprise two needles and knock-over comb bars positioned opposite to one another, and comprising ground guide bars, pattern guide bars and stitch comb bars. An example of such a knitted net is described in European Patent No. 0 723 606, to Fryszer, et al., incorporated herein by reference.

Knitted netting has a variety of end use applications, including but not limited to hay bale wrap, cargo wrap, netted bags, and drainage nets. Raschel knitted nets have been used for round hay bale wrapping as disclosed in U.S. Pats. No. 4,569,439 and No. 4,570,789, both of which are incorporated herein by reference. Twines and films have also been used to tie up hay bales; however the twine usually cuts in the bale and doesn't provide ample support to keep the bale tidy and neat. Further, the twining of the rolled bales with the binding yarn is relatively time-consuming and requires substantial manual labor. Film covers don't allow the rolled bale enough air circulation, which lead to the growth of mold and eventually rotting. The Raschel knitted net doesn't cut into the hay bale and allow ample amount of air to circulate through the bale. Although Raschel knitted netting has several advantages over twine and plastic film, the netting tends to shrink in overall width when pulled lengthwise. Due to the shrinkage in the width, the outer most edges of the hay bale are left exposed, which can cause the bale to become disheveled during pick-up and transport.

There is an unmet need for a bale cover that will provide maximum coverage to a rounded bale maintaining the rolled bale compact shape during pick-up and transport, as well as during storage.

SUMMARY OF THE INVENTION

The present invention is directed to a laminated net, and more specifically to a laminate comprising a nonwoven fabric and knitted net to be utilized as rounded bale wrap, wherein the wrap maintains the integrity of the bale during, pick-up, transport, and storage.

The net of the present invention is laminate to nonwoven fabric. The nonwoven fabric provides additional coverage to the rounded bale so as to maintain the compact shape of the bale during pick-up, transport, and storage. Preferably, the nonwoven fabric is a continuous filament fabric. The knitted netting and nonwoven fabric may be mechanically or chemically bonded by various means.

In accordance with the present invention, the netting comprises a plurality of chain yarns orientated in a first direction and a plurality of fill yarns orientated in a second direction. The yarns of the present invention may comprise flat filaments, such as tapes, monofilaments, or a combination thereof. The filaments of the nonwoven fabric and/or the knitted net may be of similar or dissimilar polymeric compositions. Suitable filaments, which may be blended in whole or part with natural or synthetic polymeric compositions, include polyamides, polyesters, polyolefins, polyvinyls, polyacrylics, and the blends or coextrusion products thereof. The synthetic polymers may be further selected from homopolymers; copolymers, conjugates and other derivatives including those thermoplastic polymers having incorporated melt additives or surface-active agents.

Subsequent to formation of the nonwoven web and knitted net, the nonwoven web and/or knitted net may optionally be subjected to various chemical and/or mechanical post-treatments so as to impart a specific performance to the laminate.

DETAILED DESCRIPTION

While the present invention is susceptible of embodiment in various forms, there will hereinafter be described, presently preferred embodiments, with the understanding that the present disclosure is to be considered as an exemplification of the invention, and is not intended to limit the invention to the specific embodiments disclosed herein.

In accordance with the present invention, the differentially elongated knit is formed on a Raschel knitting machine. The machine comprises a plurality of latch needles, a plurality of lapping belts, a yarn laying-in comb and a plurality of guide bars having needle guides thereon. The latch needles are mounted in the machine to carry out a reciprocating motion in a given plane while the lapping belts are spaced from the needles on one side of the plane, i.e., on a downstream side, for guiding pattern yarns to the needles. In addition, the laying-in comb is mounted on the same side of the plane of the latch needles as the lapping belts and carries out an orbital motion perpendicularly of the plane of the latch needles to penetrate between the pattern yarns. The guide bars with the needle guides serve to lay-in stitch yarns and are mounted on an opposite side of the plane of the latch needles from the lapping belts, i.e., on the upstream side, and oscillate at an angle to the pattern yarns.

Figure 1:
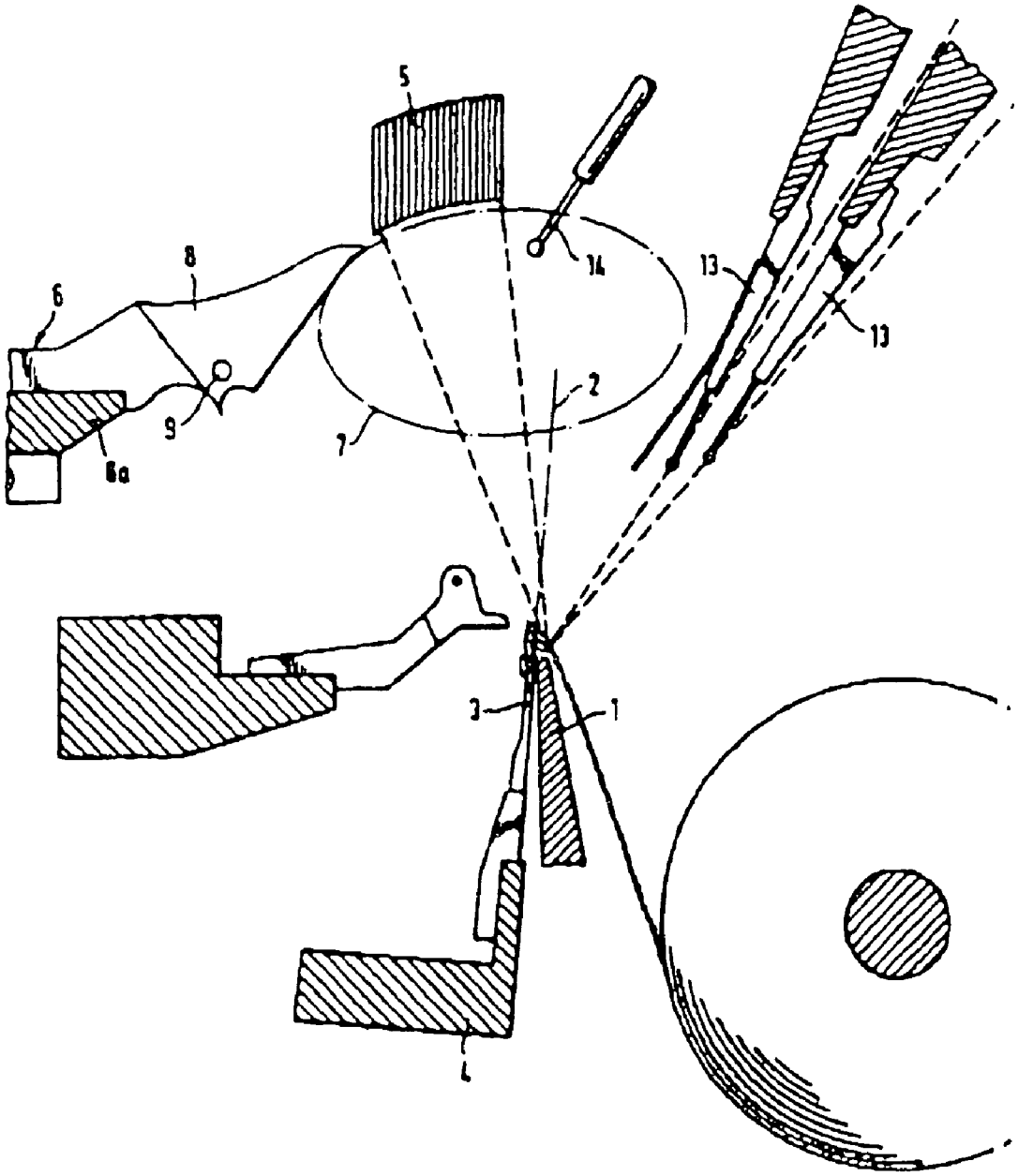
FIG. 1 illustrates a view of a portion of a Raschel machine.

FIG. 1, is representative of a Raschel machine, whereby it is provided with a comb plate 1 in which a plurality of latch needles 3 are mounted for reciprocating motion along their axes 2 in a vertical plane, as viewed. As shown, the needles 3 are disposed on a bar 4 which is movable up and down.

In addition, the machine includes a plurality of lapping belts or guide bars 5 spaced from the needles 3 on one side, i.e., the downstream side, of the plane of the needles 3 for guiding pattern yarns to the needles 3. A yarn laying-in comb 6 is also mounted on the same side of the plane 2 of the latch needles 3 in order to carry out an orbital motion perpendicularly of the plane 2 while penetrating between the pattern yarns. As indicated in chain-dotted line 7, the orbital motion is a combined stroke and oscillating motion. The comb 6 is provided with a plurality of parallel sinkers 8 each of which carries a guide rod 9 and which has a deflecting edge 10 at the forward end extending towards the plane 2. In addition, each sinker 8 has a yarn catch 11 at a lower region of the deflecting edge 10 below the guide rod 9. A trace comb 12 is also mounted over the comb plate 1 in known manner.

The machine also has a plurality of guide bars 13 which have needle guides thereon for directing stitch yarns to the latch needles 3. As shown, the guide bars 13 are mounted on the side of the plane 2 of the latch needles 3 opposite the lapping belts 5, i.e., on the upstream side. Suitable means are also provided for oscillating the guide bars 13 at an angle to the pattern yarns.

As shown in FIG. 1, the lapping belts 5 are positioned at an acute angle downstream of the plane 2. A yarn guide 14 is also disposed between the belts 5 and the guide bars 13 for deflecting the pattern yarns upon laying-in of the stitch yarns. This yarn guide 14 is used for laying the pattern yarns in the needle lanes (not shown). The yarn guide 14 may be coupled to the guide bars 13 so as to move therewith or may be provided with an independent drive (not shown).

The Raschel knitted net of the present invention is laminated to a nonwoven fabric to provide improved coverage to the rounded bale. Preferably, the nonwoven fabric is a continuous filament fabric. In general, continuous filament nonwoven fabric formation involves the practice of the spunbond process. A spunbond process involves supplying a molten polymer, which is then extruded under pressure through a large number of orifices in a plate known as a spinneret or die. Optionally, the molten polymer may incorporate a filament modifying melt additive. The resulting continuous filaments are quenched and drawn by any of a number of methods, such as slot draw systems, attenuator guns, or Godet rolls. The continuous filaments are collected as a loose web upon a moving foraminous surface, such as a wire mesh conveyor belt. When more than one spinneret is used in line for the purpose of forming a multi-layered fabric, the subsequent webs are collected upon the uppermost surface of the previously formed web. The web is then at least temporarily consolidated, usually by means involving heat and pressure, such as by thermal point bonding. Using this means, the web or layers of webs are passed between two hot metal rolls, one of which has an embossed pattern to impart and achieve the desired degree of point bonding, usually on the order of 10 to 40 percent of the overall surface area being so bonded.

Subsequent to formation of the nonwoven web, the nonwoven may optionally be subjected to various chemical and/or mechanical post-treatments. For instance, the nonwoven web may be imparted with hydrophobicity and/or antimicrobials. Further, the nonwoven web may be microcreped, apertured, or three-dimensionally imaged to impart a specific performance to the web. A particular microcreping process that can be employed is commercially available from the Micrex Corporation of Walpole, Mass., and is referred to by the registered mark of the same company as "MICREX". The apparatus for performing MICREXING is described in U.S. Pat. No. 3,260,778; No. 3,810,280; No. 4,090,385; and No. 4,717,329, hereby incorporated by reference.

Figure 2:
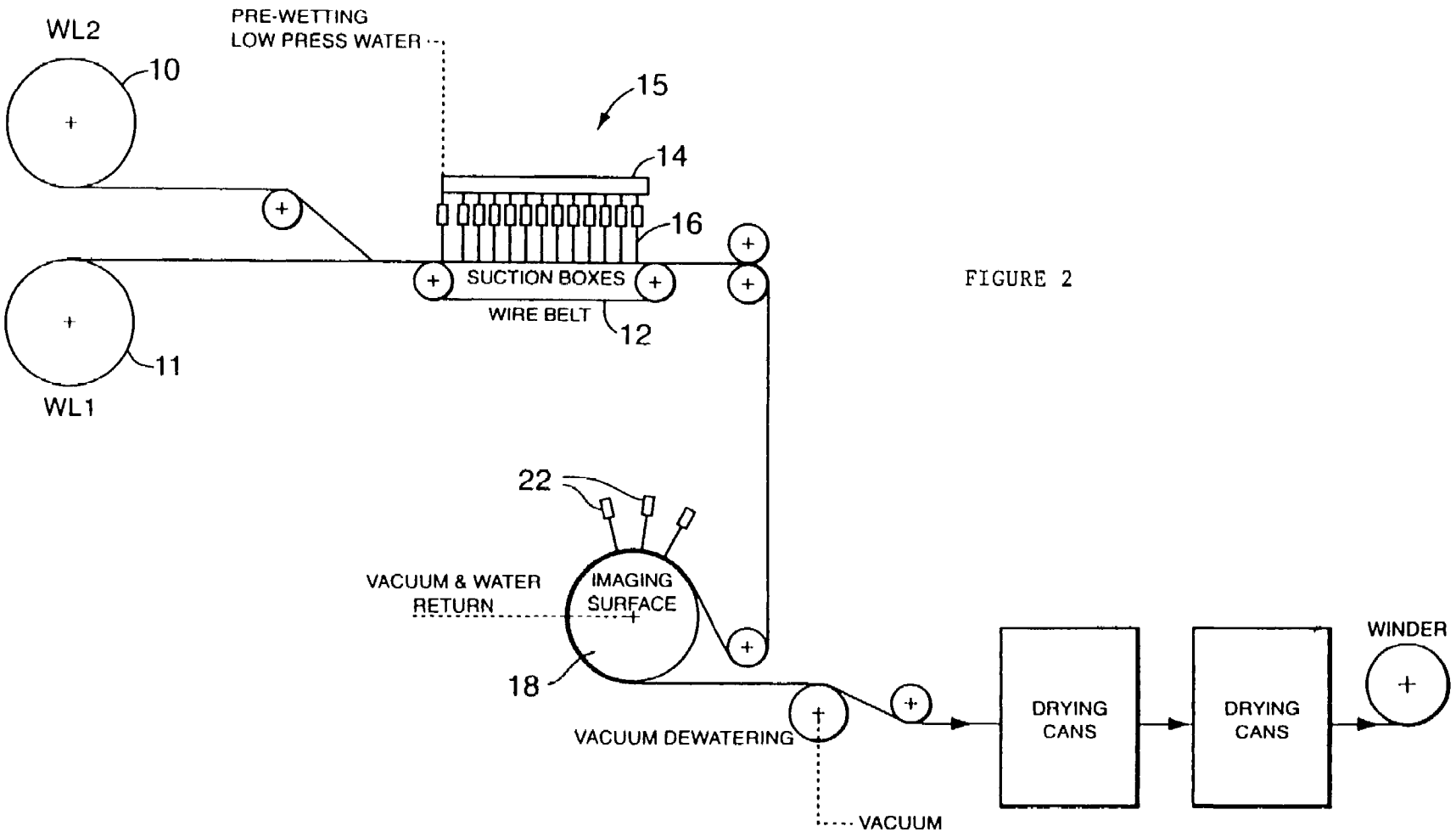
FIG. 2 is a diagrammatic view of an apparatus for imparting a three-dimensional image into a fabric.

FIG. 2 includes an imaging and patterning drum 18 comprising a three-dimensional image transfer device for effecting imaging and patterning of a nonwoven web. The formed web is trained over a guide roller 20 and directed to the image transfer device 18, where a plurality of three-dimensional images are imparted into the fabric on the foraminous forming surface of the device. The web of fibers is juxtaposed to the image transfer device 18, and high pressure water from manifolds 22 is directed against the outwardly facing surface from jet spaced radially outwardly of the image transfer device 18. The image transfer device 18, and manifolds 22, may be formed and operated in accordance with the teachings of commonly assigned U.S. Pat. No. 4,098,764, No. 5,244,711, No. 5,822,823, and No. 5,827,597, the disclosures of which are hereby incorporated by reference. The fabric can be vacuum dewatered at 24, and dried at an elevated temperature on drying cans 26.

The Raschel knitted netting and spunbond nonwoven fabric may be mechanically or chemically bonded by various means known by those skilled in the art, including but not limited to adhesive or stitching.

Subsequent to formation, the laminate net material may optionally be subjected to various chemical and/or mechanical post-treatments. The material is then collected and packaged in a continuous form, such as in a roll form, or alternatively, the laminate net material may comprise a series of weak points whereby desired lengths of twine material may be detracted from the remainder of the continuous packaged form.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims

What is claimed is:

1. A method of making a hay baling laminate comprising the steps of:

a. providing a knitted, polymeric net comprising yarns selected from the group consisting of polyamides, polyesters, polyolefins, polyvinyls, polyacrylics, and the combinations thereof;

b. providing a single three-dimensional imaged, polymeric nonwoven fabric comprising elements selected from the group consisting of polyamides, polyesters, polyolefins, polyvinyls, polyacrylics, and the combinations thereof;

c. bonding only said knitted net to said single nonwoven fabric to form a hay baling laminate; and d. winding said hay baling laminate into roll form.

2. A method of making a hay baling laminate as in claim 1, wherein said knitted net is a Raschel knit.

3. A method of making a hay baling laminate as in claim 1, wherein said nonwoven fabric is a spunbond nonwoven fabric.

4. A method of making a hay baling laminate as in claim 1, wherein said knitted net and said nonwoven fabric are adhesively bonded.

5. A method of making a hay baling laminate as in claim 1, wherein said yarns are polymeric tapes, filaments, or a combination thereof.

6. A method of making a hay baling laminate as in claim 1, wherein said laminated knitted net comprises a post-treatment.

7. A method of making a hay baling laminate as in claim 1, wherein said nonwoven fabric is mechanically compacted.

8. A method of making a hay baling laminate comprising the steps:

a. providing a knitted, polymeric net comprising yarns selected from the group consisting of polyamides, polyesters, polyolefins, polyvinyls, polyacrylics, and the combinations thereof;

b. providing a single apertured, polymeric nonwoven fabric comprising elements selected from the group consisting of polyamides, polyesters, polyolefins, polyvinyls, polyacrylics, and the combinations thereof;

c. bonding only said knitted net to said single nonwoven fabric to form a hay baling laminate; and d. winding said hay baling laminate into roll form.

9. A method of making a hay baling laminate as in claim 8, wherein said knitted net is a Raschel knit.

10. A method of making a hay baling laminate as in claim 8, wherein said nonwoven fabric is a spunbond nonwoven fabric.

11. A method of making a hay baling laminate as in claim 8, wherein said knitted net and said nonwoven fabric are adhesively bonded.

12. A method of making a hay baling laminate as in claim 8, wherein said yarns are polymeric tapes, filaments, or a combination thereof.

13. A method of making a hay baling laminate as in claim 8, wherein said laminated knitted net comprises a post-treatment.

14. A method of making a hay baling laminate as in claim 8, wherein said nonwoven fabric is mechanically compacted.

15. A method of making a hay baling laminate as in claim 8, further comprising providing a series of weak points in said laminate wherein lengths of the laminate may be detracted from a remainder thereof.

16. A method of making a hay baling laminate as in claim 1, further comprising providing a series of weak points in said laminate wherein lengths of the laminate may be detracted from a remainder thereof.

17. A method of making a hay baling laminate as in claim 8, further comprising providing the laminate as a rounded hay bale wrap.

* * * * *